US010624403B2

(12) United States Patent
Seela

(10) Patent No.: US 10,624,403 B2
(45) Date of Patent: Apr. 21, 2020

(54) MALLEABLE PROTECTIVE INSERT FOR HEADGEAR

(71) Applicant: Rithvik Seela, Orlando, FL (US)

(72) Inventor: Rithvik Seela, Orlando, FL (US)

( * ) Notice: Subject to any disclaimer, the term of this patent is extended or adjusted under 35 U.S.C. 154(b) by 61 days.

(21) Appl. No.: 15/928,949

(22) Filed: Mar. 22, 2018

(65) Prior Publication Data

US 2019/0082763 A1 Mar. 21, 2019

Related U.S. Application Data

(60) Provisional application No. 62/560,847, filed on Sep. 20, 2017.

(51) Int. Cl.

| | |
|---|---|
| ***A42B 3/00*** | (2006.01) |
| ***A42B 1/08*** | (2006.01) |
| ***A42B 1/24*** | (2006.01) |

(52) U.S. Cl.

CPC ..... *A42B 1/08* (2013.01); *A42B 1/24* (2013.01); *A42B 3/00* (2013.01)

(58) Field of Classification Search

CPC ..... A42B 3/32; A42B 3/06127; A42B 3/128; A42B 1/062; A42B 1/205

USPC ..... 2/411, 412

See application file for complete search history.

(56) References Cited

U.S. PATENT DOCUMENTS

| | | | | |
|---|---|---|---|---|
| 3,153,792 | A * | 10/1964 | Marietta | A42B 3/127 2/414 |
| 5,557,807 | A * | 9/1996 | Hujar | A42B 1/008 2/171.2 |
| 9,572,390 | B1 * | 2/2017 | Simpson | A42B 3/063 |
| 2002/0100106 | A1 * | 8/2002 | Simmons | A42B 1/008 2/171.2 |
| 2007/0000025 | A1 * | 1/2007 | Picotte | A42B 1/08 2/171 |
| 2012/0066820 | A1 * | 3/2012 | Fresco | A41D 13/0153 2/463 |

* cited by examiner

*Primary Examiner* — Timothy K Trieu

(74) *Attorney, Agent, or Firm* — Jason T. Daniel, Esq.; Daniel Law Offices, P.A.

(57) ABSTRACT

A protective insert for headgear includes a malleable main body member having an inside facing surface, an outside facing surface and an impact resistant material that is disposed between the inside and outside facing surfaces. A plurality of connectors are disposed along the insert, and removably engage complementary connectors positionable inside a traditional hat. A plurality of air vents are disposed throughout the main body, and the impact resistant material includes polyurethane foam and polyborodimethylsiloxanea, which is malleable in a non-compressed state, and becomes firm and rigid when receiving an impact force.

8 Claims, 4 Drawing Sheets

MALLEABLE PROTECTIVE INSERT FOR HEADGEAR

CROSS-REFERENCE TO RELATED APPLICATIONS

This application claims the benefit of U.S. Application Ser. No. 62/560,847 filed on Sep. 20, 2017, the contents of which are incorporated herein by reference.

TECHNICAL FIELD

The present invention relates generally to safety products, and more particularly to a malleable protective insert for headgear such as a hat.

BACKGROUND

The statements in this section merely provide background information related to the present disclosure and may not constitute prior art.

Bicycles and skateboards are becoming increasingly popular because they positively impact the environment by reducing gas emissions while providing a cheap, versatile mode of transportation. In the United States alone, upwards of 5.8 million people under the age of 18 reported regular use of skateboards, with even more relying on bicycles, scooters and other types of wheeled conveyances for their daily activities. When factoring in the different populations across the globe, the dependence on these devices for transportation becomes evident, even among different age groups.

With this increasing dependence, injury rates have skyrocketed. Although many injuries are not life threatening, injuries to the head may lead to loss of motor functions, behavioral issues, and in severe cases, death. As the medical understanding of the potential long lasting and sometimes permanent effects of head trauma can have on affected individuals has increased, there has been an appreciation of the fact that protective headgear can reduce such trauma significantly in many cases.

Unfortunately, there remains a large population of adolescents who refuse to wear protective headgear, choosing instead to wear non-protective hats, such as a snapback hat, for example. When directly questioned, many polled individuals say that they would wear helmets if they were made to be more comfortable and aesthetically pleasing, so as to resemble a snapback hat.

Accordingly, it would be beneficial to provide a protective hat insert that can be used with any type of hat, in order to impart the safety benefits of a helmet with the comfort and aesthetics of a hat.

SUMMARY OF THE INVENTION

The present invention is directed to a malleable protective insert for headgear. One embodiment of the present invention can include a malleable main body member having an inside facing surface, an outside facing surface and an impact resistant material that is disposed between the inside and outside facing surfaces. A plurality of connectors can be disposed along the insert, and can engage complementary connectors positionable inside a traditional hat. The connectors and complementary connectors function to allow the insert to be removably secured to any hat.

In one embodiment, the impact resistant material includes polyurethane foam and polyborodimethylsiloxanea, which is malleable in a non-compressed state, and becomes firm and rigid when receiving an impact force.

In one embodiment, a plurality of air vents are disposed throughout the main body to provide air to a wearer's head during use.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
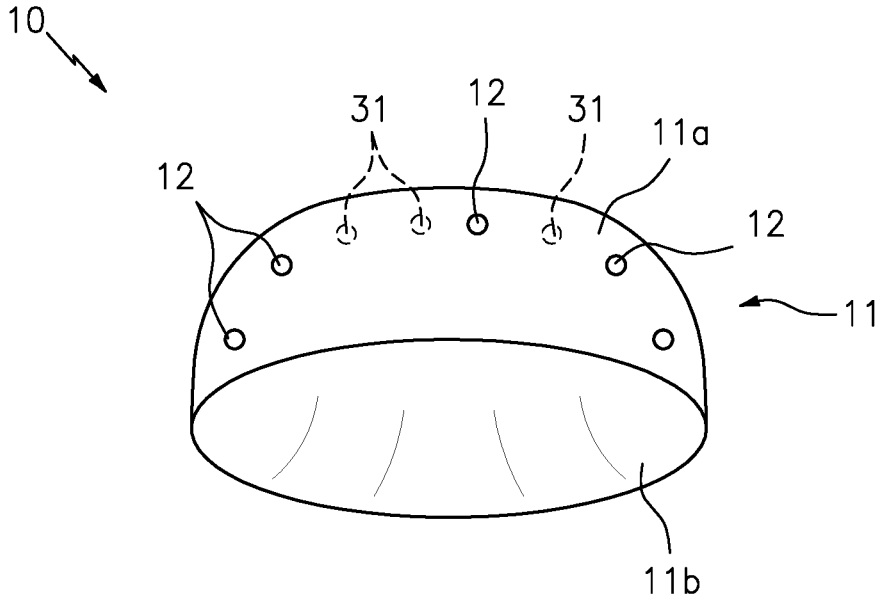
FIG. 1 is a perspective view of a protective insert for headgear that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

FIGS. 1-3B illustrate one embodiment of a malleable protective insert for headgear that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown in FIG. 1, the insert 10 can include a malleable main body 11 that is shaped to conform to a human head. In the illustrated embodiment, the main body can include a generally dome-shaped member having an outside facing surface 11*a*, and an inside facing surface 11*b*. In various embodiments, a plurality of air vents 12 can be secured along the main body and can extend from the top surface to the bottom surface.

Figure 2:
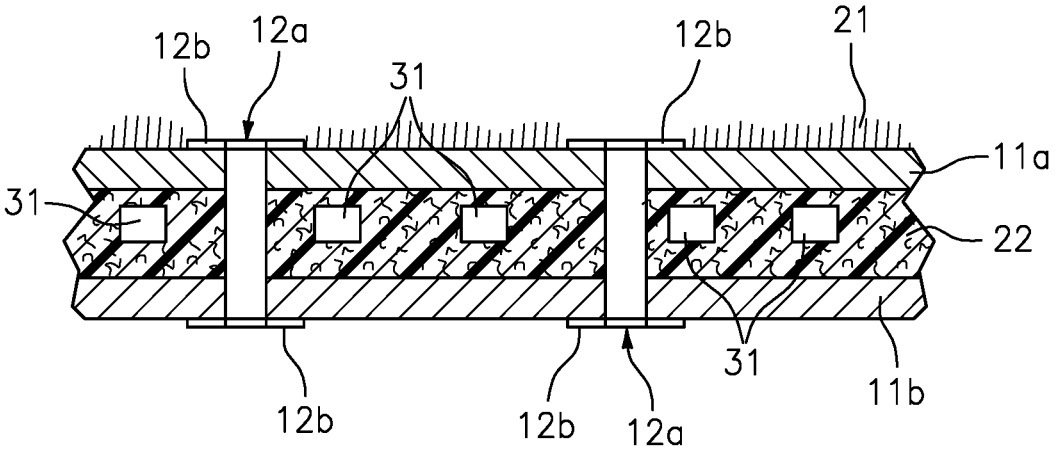
FIG. 2 is a cross-sectional side view of the main body of the protective insert, in accordance with one embodiment of the invention.

As illustrated in cross sectional FIG. 2, the main body 11 can preferably include a layered construction, wherein each layer performs a different and specific function. In one embodiment, the outside facing surface 11*a* can be constructed from a continuous sheet of nylon and/or polyester having a plurality of connectors disposed thereon. In the preferred embodiment, the connectors can comprise a plurality of integrated loops 21 formed as a part of the outside facing layer. As will be described below, these loops can engage with complementary connectors 30, in order to secure the main body 11 to the inside of a hat. Of course, any number of other construction materials and connectors may also be utilized. For example, in one embodiment, the inside and outside facing layers can include identical construction materials, and a plurality of connectors 31 in the form of magnetic elements can be embedded within the middle layer. These magnetic elements can be attracted to complementary connectors 30, such as metallic and/or complementary magnetic elements, disposed along the hat, and can secure the main body to the hat using an attractive force.

The middle layer 22 can function to protect the users head from impacts, as may be encountered from a fall, for example. In the preferred embodiment, the middle layer can include, comprise or consist of a sheet of malleable and impact resistant polyurethane foam with traces of polyborodimethylsiloxanea. As will be known to those of skill in the art, this combination of materials is highly flexible, but becomes firm and rigid when impacted by an outside force. The rigidity functions to allow the material to absorb and disperse the energy from the impact before returning back to its flexible state. One example of a suitable impact-resistant foam includes the LP1 D3O product that is commercially available from D3O®, for example. Of course, any number of other impact resistant materials such as high density foam, for example, are also contemplated.

The inside facing surface/layer 11*b* is designed to be in direct contact with the head of the user wearing the insert. In the preferred embodiment, the third layer can include, comprise or consist of a wicking fabric such as high tech polyester, for example, that actively draws moisture and odors away from the body. Of course, any number of other materials that are suitable for direct contact with the human body are also contemplated. Several nonlimiting examples include cotton and wool, for example.

As shown, each of the air vents can comprise elongated pieces of flexible plastic or foam, for example, having a central aperture 12*a* extending therethrough. Owing to the specific nature of polyurethane foam and polyborodimethylsiloxanea, it is preferred that each end of the air vents 12*b* include outward radiating flanges that are secured to the first and third layers of the main body. Such a feature ensures that each of the airways will remain open and exposed at all times, regardless of the movement of the middle layer relative to the outer layers.

Although described above with respect to a specific shape, size, and/or particular number of layers, this is for illustrative purposes only. To this end, those of skill in the art will recognize that the main body 11 can include any number of different shapes and sizes, and can further be constructed utilizing any number of different layers and/or materials, without limitation. In either instance, it is preferred that the insert 10 be constructed so as to capable of withstanding the rigors of being laundered (i.e., being repeatedly washed and dried via a conventional washing machine and dryer), without affecting the above described functionality.

Figure 3A:
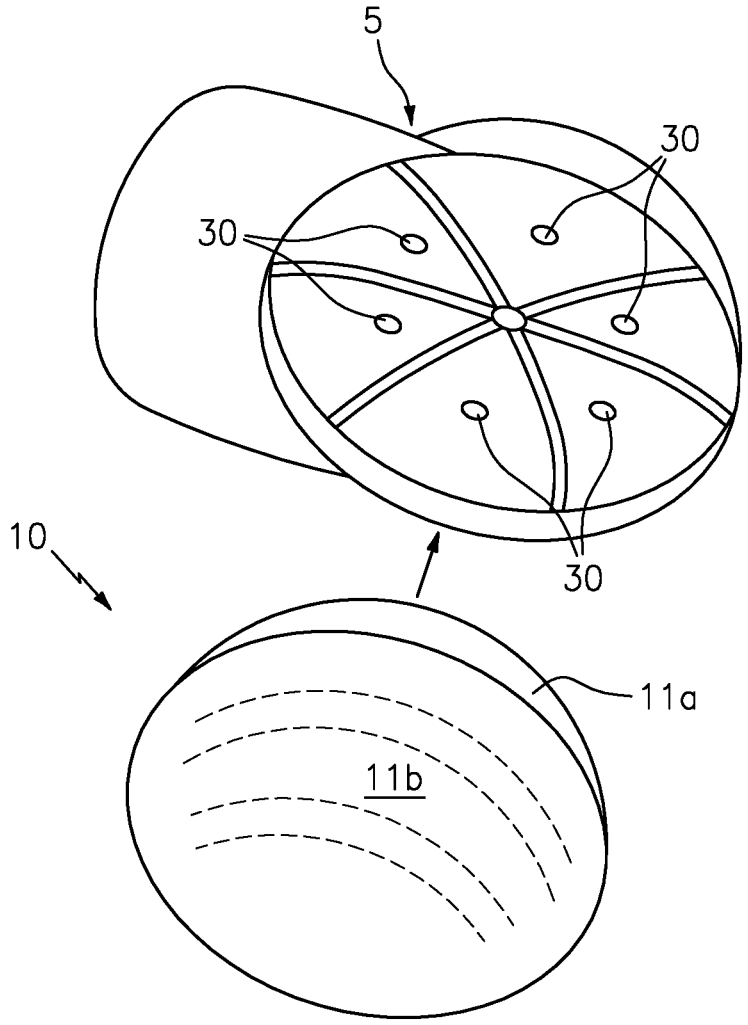
FIG. 3A is a perspective view of the protective insert in operation, in accordance with one embodiment of the invention.
Figure 3B:
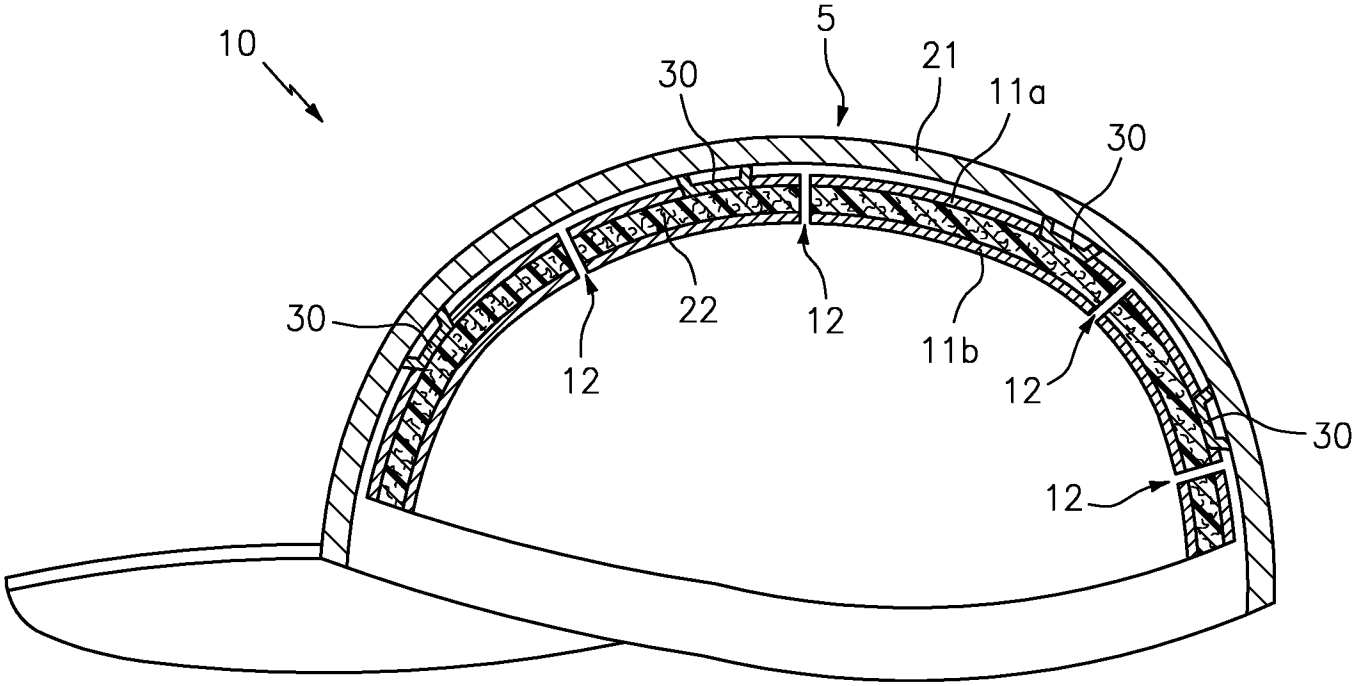
FIG. 3B is a cross-sectional view of the protective insert in operation, in accordance with one embodiment of the invention.

As shown in FIGS. 3A and 3B, a plurality of complementary connectors 30 can be disposed along the inside portion of any type of headgear, such as the illustrated hat 5. As described herein, the terms "connector," "complementary connector" and derivatives thereof can include any number of different elements capable of repeatedly securing two items together in a nonpermanent manner. Several nonlimiting examples include opposing strips of hook and loop material (i.e. Velcro®), magnetic elements, and compression fittings such as snaps and buttons, for example. Each illustrated connector can be permanently secured to the illustrated portion of the device via a permanent sealer such as glue, adhesive tape, or stitching, for example.

In operation, a user can position the insert 10 within the basket portion of the hat. Owing to the malleable nature of the insert, it is possible to arrange the main body to conform exactly to the shape of the hat. Once positioned, the integrated connector(s) 21 and/or 31 within the insert 10 can engage the complementary connectors 30 along the hat to prevent the insert from becoming separated during use.

While the dimensions of the elements are not critical, in the preferred embodiment the main body 11 can be as thin as possible. To this end, the main body 11 will preferably include a thickness (e.g., distance between the first and third layers) of between 0.25 and 0.75 inches. Such dimensions are preferred to ensure that utilization of the insert between a hat and the users head will not affect the look of the hat from the outside. Moreover, owing to the malleable qualities of the insert, using the device 10 will not affect the ability of the user to adjust the position or orientation of the hat on their head, as the main body will shift and conform to the shape of the users head regardless of the orientation of the hat.

Most importantly, in the event that a user falls while wearing the device, the impact force that passes from an external object through the hat 5 can be substantially absorbed by the insert in the manner discussed above. Accordingly, the above described insert can function to protect wearers against serious head injuries while remaining hidden beneath a conventional hat, so as to overcome the above noted issues associated with traditional headgear safety devices.

As described herein, one or more elements of the malleable protective insert for headgear 10 can be secured together utilizing any number of known attachment means. Moreover, although the above embodiments have been described as including separate individual elements and/or layers, the inventive concepts disclosed herein are not so limiting. To this end, one of skill in the art will recognize that one or more individually identified elements may be formed together as one or more continuous elements, either through manufacturing processes, such as casting or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. A protective insert for headgear, said insert comprising: a main body member having a unitary and malleable top layer, a unitary malleable and impact resistant middle layer, and a unitary and malleable bottom layer, each of said layers to conform to a dome shape is configured to cover user's head; and a plurality of air vents that are disposed along the main body, each of the air vents extending from a top surface of a main body to a bottom surface of the main body;

and further comprising: a plurality of magnetic elements that are disposed throughout the middle layer; and a plurality of loops extending upward from the top surface of the main body; further comprising: a plurality of complementary connectors that are configured to be removably secured to a hat, said complementary connectors comprising additional magnetic elements; said each of additional magnetic elements that are configured to engage the plurality of magnetic elements disposed throughout the middle layer of the main body; and strips of hook material that are configured to removably engage the plurality of loops.

2. The insert of claim 1, further comprising:

said plurality of complementary connectors that are configured to be removably secured to a hat, said complementary connectors comprising strips of hook material that are configured to removably engage the plurality of loops.

3. The insert of claim 1, wherein the bottom layer of the main body is constructed from a moisture wicking fabric.

4. The insert of claim 1, wherein the malleable and impact resistant middle layer is constructed from a material that becomes firm and rigid when receiving an impact force.

5. The insert of claim 4, wherein the middle layer comprises polyurethane foam and polyborodimethylsiloxanea.

6. The insert of claim 1, wherein the main body includes a thickness of between 0.25 and 0.75 inches, and is configured to be unobtrusively worn beneath a hat.

7. The insert of claim 1, wherein each of the plurality of air vents comprise:

an elongated flexible tube having a first end along the top surface of the main body, and a second end along the bottom surface of the main body.

8. The insert of claim 7, wherein each of the plurality of air vents includes a first flange along the first end of the flexible tube, and a second flange along the second end of the flexible tube.

* * * * *